US010948168B2

(12) United States Patent
Liang et al.

(10) Patent No.: US 10,948,168 B2
(45) Date of Patent: Mar. 16, 2021

(54) DOWNLIGHT APPARATUS

(71) Applicant: XIAMEN ECO LIGHTING CO. LTD., Xiamen (CN)

(72) Inventors: Jinhui Liang, Xiamen (CN); Yongzhe Dong, Xiamen (CN); Xiaoliang Wen, Xiamen (CN); Shouqiang Hou, Xiamen (CN)

(73) Assignee: XIAMEN ECO LIGHTING CO. LTD., Xiamen (CX)

( * ) Notice: Subject to any disclaimer, the term of this patent is extended or adjusted under 35 U.S.C. 154(b) by 0 days.

(21) Appl. No.: 16/387,200

(22) Filed: Apr. 17, 2019

(65) Prior Publication Data

US 2020/0224857 A1 Jul. 16, 2020

(30) Foreign Application Priority Data

Jan. 15, 2019 (CN) ..... 201920060930.4

(51) Int. Cl.

| | |
|---|---|
| ***F21V 14/06*** | (2006.01) |
| ***F21V 5/04*** | (2006.01) |
| ***F21S 8/02*** | (2006.01) |
| ***F21V 21/40*** | (2006.01) |
| ***F21Y 113/13*** | (2016.01) |
| ***F21Y 115/10*** | (2016.01) |
| *F21V 29/70* | (2015.01) |

(52) U.S. Cl.

CPC ..... *F21V 14/06* (2013.01); *F21S 8/026* (2013.01); *F21V 5/04* (2013.01); *F21V 21/40* (2013.01); *F21V 29/70* (2015.01); *F21Y 2113/13* (2016.08); *F21Y 2115/10* (2016.08)

(58) Field of Classification Search

CPC . F21V 14/06; F21V 21/40; F21V 5/04; F21V 29/70; F21S 8/026; F21Y 2115/10; F21Y 2113/13

See application file for complete search history.

(56) References Cited

U.S. PATENT DOCUMENTS

| | | | | |
|---|---|---|---|---|
| 5,893,626 | A * | 4/1999 | Poling | B62J 6/04 362/231 |
| 6,654,172 | B2 * | 11/2003 | Pond | B60Q 1/2607 359/619 |
| 7,896,524 | B2 * | 3/2011 | Yoneda | F21V 5/00 362/231 |
| 7,988,318 | B1 * | 8/2011 | Smith | G01N 21/255 362/184 |
| 8,419,213 | B1 * | 4/2013 | Rubtsov | F41H 13/0087 340/573.1 |
| 8,672,507 | B2 * | 3/2014 | Hall | F21K 9/00 362/231 |
| 8,926,121 | B2 * | 1/2015 | Wu | H05B 33/0863 362/184 |
| 9,964,286 | B1 * | 5/2018 | Sooferian | F21V 9/40 |

(Continued)

*Primary Examiner* — Tsion Tumebo

(74) *Attorney, Agent, or Firm* — Chun-Ming Shih; Lanway IPR Services

(57) ABSTRACT

A downlight apparatus includes a container housing, a light source module, and a lens module. The lens module is moved by a user along a movable spacing defined by a bracket of the container. The lens module has different types of lens areas. By moving the lens module at a relative position with respect to a light source module mounted in the container housing, the output light is produced with a desired light pattern and parameters.

15 Claims, 8 Drawing Sheets

(56) References Cited

U.S. PATENT DOCUMENTS

| | | | | |
|---|---|---|---|---|
| 2009/0103293 | A1* | 4/2009 | Harbers | F21V 9/40 362/231 |
| 2010/0188018 | A1* | 7/2010 | Salm | F21V 7/00 315/294 |
| 2010/0284192 | A1* | 11/2010 | Chen | F21K 9/00 362/311.02 |
| 2011/0194282 | A1* | 8/2011 | Paik | F21V 5/007 362/245 |
| 2012/0081901 | A1* | 4/2012 | Tsang | F21V 14/06 362/277 |
| 2012/0287621 | A1* | 11/2012 | Lee | F21V 14/06 362/231 |
| 2013/0182441 | A1* | 7/2013 | Nemeyer | F21L 4/005 362/277 |
| 2013/0208481 | A1* | 8/2013 | Sooferian | F21V 14/02 362/280 |
| 2014/0049967 | A1* | 2/2014 | Zhou | F21V 14/06 362/287 |
| 2014/0233246 | A1* | 8/2014 | Lafreniere | F21S 8/026 362/364 |
| 2015/0159830 | A1* | 6/2015 | Joergensen | F21V 5/007 362/237 |
| 2015/0211708 | A1* | 7/2015 | Stavely | F21V 5/007 348/164 |
| 2015/0252983 | A1* | 9/2015 | Lee | F21V 14/065 362/109 |
| 2015/0316236 | A1* | 11/2015 | Lin | F21V 17/02 362/277 |
| 2016/0215961 | A1* | 7/2016 | Kjeldsen | F21V 5/007 |
| 2019/0041028 | A1* | 2/2019 | Bremerich | F21V 5/007 |

* cited by examiner

DOWNLIGHT APPARATUS

FIELD

The present invention is related to a downlight apparatus and more particularly related to a downlight apparatus that is adjustable.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures, and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

In an embodiment, a downlight apparatus includes a container housing, a light source module and a lens module.

The container housing has a light opening and a container space. The light source module is disposed in the container housing for emitting a first light to the light opening.

The lens module is disposed in a light emitting path of the light source module toward the light opening. For example, the light source module includes multiple LED modules mounted on a light source plate. The light source plate is fixed to the container housing. When the LED modules are driven with proper driving currents, the LED modules emit light to the light opening. In some embodiments, each LED module emits most of light, e.g. more than 80%, within 120 degrees from center of the LED module. When multiple LED modules are disposed close to each other, these LED modules together emit a wider light.

In some embodiments, the lens module is attached to the container housing with fixing structure like screws, support columns, socket structures, locking structures. In some embodiments, there is some remaining space in the containing space except for space occupied by the light source module. In such remaining space, heat sink elements may be disposed for helping carry heat generated by the light source module.

The lens module is manually movable for adjusting a first relative position with respect to the light source for adjusting an output light. Users may touch a portion of the lens module directly for moving the lens module. Alternatively, users may control a control unit connected to the lens module for moving the lens module with respect to the light source module to a different first position.

For example, when there are different lens areas arranged on the lens module for providing different optical conversion, positions of one or more LED modules, e.g. directly on top of a lens area or with an angle with respect to the lens area, cause different conversion result, e.g. different light beam widths, different light patterns.

The output light is generated by passing the first light through the lens module, e.g. from refraction. By preparing different lens surface and related parameters, the output light may have different optical characteristics.

In some embodiments, the lens module contain lens for decreasing blue light component, to prevent damage of human eyes while being exposed to the blue light for too much time.

The light components of the light source module may receive driving currents from a separate driver module. The driver module converts an external power source, like 110V or 220V alternating current to direct currents of lower voltage level as driving currents to the light source module.

Pulse modulation or other driving mechanisms may be used by the driver module to provide driving currents to the LED module. In some embodiments, users may also control the driver module to adjust light strength of the output light. When adjusting the light strength of the output light, different types of LED modules of the light source module may be adjusted with different changing ratios, thus changing other optical characteristics while changing overall luminance level. For example, the decreasing of luminous level may simulate sunlight spectrum from noon to sunset, while color temperature also changes when luminance level is changed.

Such control may also be issued from an external device, e.g. via a wire or a wireless channel. The external device may be a mobile phone implementing a IoT (Internet of Things) protocol for sending an external command to the driver module. In some other embodiments, the external device may be a specific remote control or another downlight apparatus that issues commands to perform co-working among multiple downlight apparatuses.

When the external command is sent via a wireless channel, e.g. via Wi-Fi, Bluetooth, Zigbee, Z-wave, there is an antenna and a communication circuit disposed in or coupled to the driver module. In such case, the antenna may be disposed at the lens module, e.g. on surface of the lens module, to get best communication quality.

The driver module may be disposed in a driver container that is attached or mounted to the container housing. In some other embodiments, the driver module is connected to the light source module via a though hole of the container housing using a wire. In the intermediate contact between the light source module and the driver module, a plugging structure, e.g. a pin and associated socket may be used.

In some embodiments, driver components may be disposed and integrated with the light source module, e.g. placing driver circuits on a substrate that is also used for mounting LED modules.

The main housing may have a cup shape, with a closed top, a lateral wall and a light opening on opposite end to the closed top.

The light source module may be a light source plate disposed closer to the closed top than to the light opening.

There may be one or more support elastic arms, expandable for keeping the main housing staying in an installation cavity of a ceiling. The support elastic arms may be fixed at lateral wall of the container housing.

The concept mentioned here is not limited to downlight apparatuses. For example, spot light apparatuses may also be modified to integrate one or more features mentioned in this disclosure. For example, a spot light apparatus is used for generating a light beam to emphasize an object. Usually, the spot light apparatus has a lens for condensing its output light as a light beam. By arranging surface and optical parameters of its lens with one or more features mentioned below, one spot light apparatus may be conveniently to serve different needs, generating different output light types.

In addition to components specifically mentioned in this disclosure, other components like heat sink structures, reflective cups, heat dissipation air filling, may also be applied to embodiments mentioned here. Besides, the light source module may also include another lens module, e.g. some small lens directly mounted above LED modules, in addition to the lens module that is movable mentioned here.

In some embodiments, the light source modules may contain multiple types of LED modules, e.g. red, green, blue, white LED modules. In some embodiments, there are two types of white LED modules with different color temperatures. By mixing different types of LED modules, various light outputs may be provided by the same light source module.

In some embodiments, the lens module is rotated with respect to the container housing for adjusting the output light. For example, the lens module may have a lens with different lens areas. By rotating the lens, in such case, changes what lens area is below a LED module, thus generating different output light parameters.

In some embodiments, the lens module is moved to adjust a relative distance to the light source module for adjusting the output light. This is another way to change output light even the lens module has a lens with only one type of lens area. By adjusting relative distance, e.g. a type of a relative position, the output light is adjusted under optical refraction principles.

In some embodiments, there are multiple position structures for movably holding the rotated lens module to generate multiple corresponding output parameters of the output light. Specifically, there are several preferred positions corresponding to several preferred settings when designing the downlight apparatus. In such case, certain grooves and associated elastic blocks for providing a stable force to keep the lens module to keep in a preferred relative position are provided to guide and to keep the statuses for quick setting.

In some embodiments, the container housing has a bracket and a main body. The lens module is confined and placed between the bracket and the main body. Like a sandwich, in such embodiments, the lens module is kept movable while not being able to completely escape away from the main body and the bracket.

The fixture between the bracket and the main body may be detachable, e.g. with a buckle, a hooker, a plugging structure, or may be fixed, e.g. with glue, screws.

In some embodiments, the bracket has a peripheral part and a light passing cover. The peripheral part holds the light passing cover. For example, the peripheral part is a ring and the light passing cover is fixed in the ring.

The output light further passes through the light passing cover. The peripheral part may be fixed to the light module so that the light passing cover is integrated with the lens module as an integrated unit. Alternatively, these two parts may be separable.

In some embodiments, the light passing cover diffuses the output light, converting an input light to a soften light without intense light points. The surface of the light passing cover may be roughened to diffuse light, or be made of material that has mixed some particles to refract lights randomly.

In some embodiments, the light passing cover has multiple micro convex structures on one side or on both sides. The micro convex structure may have a diameter less than 5 mm. Such micro convex structures may be arranged closely forming a shining surface condensed by a lot of tiny spherical surfaces.

In some embodiments, a second lens position between the light passing cover and the lens is adjusted for adjusting an emitted light generated by passing the output light through the light passing cover. Specifically, in addition to adjust relative positions of the lens module and the container housing, the positions between the lens module and the light passing cover may also be adjusted so as to obtain more setting flexibility.

In some embodiments, the lens module may have a diffusion layer while the light passing cover has a condensed lens. Such setting is not conventional, but provides a different visual effect, better fitting some needs in some situations.

The emitted light is the output light of the lens module that is further converted by the light passing cover.

In some embodiments, the lens module has a handle confined within a movable area defined by the bracket. For example, the bracket has a peripheral wall that has a enclosing thin spacing for the handle to move inside. The handle is moved by a user and the handle is connected to the lens module. Thus, the lens module is moved. In this case, when the bracket is fixed to the container housing, the lens module is moved with respect to the container housing. The light module is fixed to the container housing, and consequently, the lens module is moved with respect to the light module when the handle is moved by the user.

Certain driving and linkage structure may be used for triggering movements as mentioned above. Therefore, in addition to have a direct and rigid linkage between the handle and lens module, certain intermediate structure like a pushing lever or more complicated structures may be used. In addition, the relative movement between the lens module and container housing may be achieved by an intermediate linkage structure. In some embodiments, the lens module may also be rotated like a round disk moving in a corresponding round track, just carried by a movement applied to the handle.

The thin spacing or a slit with its boundary may define a limited rotation range. In the movable range, several predetermined positions may correspond to several preferred settings. For users to easily identify the setting, some labels may be marked on the surface of the bracket so that users may see these labels.

In some embodiments, the light passing cover is integrated with the lens module, instead of being fixed to the container housing. In some embodiments, the light passing cover may be directly fixed to the lens module with a distance or directly attached to surface of a major lens of the lens module.

In some embodiments, the light passing lens is integrated with the lens module but still movable with respect to a major lens of the lens module that is used for converting the first light into the output light. The light passing cover, as mentioned above, converts the output light further to the emitted light escaped outside the downlight apparatus.

In some embodiments, there are multiple different lens areas disposed on the lens module for generating different conversion characteristics of the output light corresponding to the same first light. Specifically, when a light emitted from a LED module to a lens area with a relative angle, the light is refracted based on a curve surface and related optical characteristics of the lens area. A slight position change between the lens region and the LED module affects how an associated output light is rendered. When the lens module is moved more so that the LED module now emits the light to another lens region which has different optical characteristics as the previous lens region, a different output light is rendered again. In other words, different output lights, e.g. light beam width, light pattern, may be obtained by moving the lens module with respect to the container housing and the light module fixed to the container housing, even in the same downlight apparatus.

In some embodiments, different lens areas are arranged in an interleaved sector manner, so that several types of the output light appear in a corresponding interleaved manner when the lens module is moved continuously. The interleaved sector manner refers to that a lens area is expanded from one end close to a center with a same angle to another end away from the center.

In some embodiments, two types of lens areas are disposed, corresponding to movable spacing defined by the bracket mentioned above. More than two types of lens areas may be disposed, depending on design requirements.

In some embodiments, some lens area types correspond to condense light while some other lens area types correspond to diversify light. In some other embodiments, all lens area types in a lens module are used for condensing light but different lens area types have different focus length or different light beam width, e.g. some producing wider light beams than others.

In some embodiments, a first side of the lens module have multiple convex rings surrounding one after another extended from center to peripheral area. These convex rings form corresponding ring lens. Furthermore, each convex ring has micro convex belt lens distributed in a direction perpendicular to the convex ring.

Such lens surface produces nice visual and luminance effect, different from conventional lighting effect.

In some embodiments, a second side of the lens module includes one or more than one concave areas. These concave areas form another types of lens working together with the lens ring on the other side to render desired output light pattern. As mentioned above, in some embodiments, there are several lens types arranged in an interleaved sector manner and so can be these concave areas.

Please refer to FIG. 3, which illustrates a side of a lens module 4. The lens module has two different lens areas 41, 42 arranged in an interleaved sector manner. There is also a plane area 40 arranged on the illustrated first side of the lens module.

There is a connector 44 and a buckle 45 for connecting and aligning the lens module to corresponding structures of the container housing. These structures are used for limiting a movement range of the lens module 4 with respect to the container housing.

Please refer to FIG. 4. In FIG. 4, the bracket 3 has an elongated U-shaped opening 30. When the lens module 4 is placed between the bracket 3 and a main body of the container housing mentioned above, the lens module 4 is movable in the movable space. The U-shaped opening 30 limits a rotation range of the lens module 4. There is handle 44 disposed on the second side of the lens module 4.

The major lens of the lens module may be made of a one-piece plastic block by molding, forming customized convex-concave structures for generating desired lens effect.

In some embodiments, the second side of the lens module further comprises a plane area. In such design, on the second side of the lens module, there are some parts arranged with plane areas while other parts arranged with concave areas, which may be regarded as concave lens. Different surface curve shapes formed by both sides of the lens module produce different optical refraction parameters. In addition, different relative positions between the lens module and the light source module also influence how the output light is rendered.

Furthermore, by arranging the LED modules of the light source module in specific distribution corresponding to the lens structures further add design possibility to make the combination more flexible and more interesting.

In some embodiments, a desired light pattern of a output light is set and equations under optical rules are solved to find out associated lens area design of the lens module. Such equations may be solved or calculated with conventional optical simulation tools. Persons of ordinary skill in the art are supposed to be able to implement the LED module and the lens module to find out corresponding parameters to achieve the design goals, including the variation effect, options of effect to select.

In some embodiments, there are multiple types of the LED modules disposed at LED positions corresponding multiple lens areas of the lens module. As mentioned above, the relative positions between the light source module and lens module influence how an output light is rendered. On the other hand, the distribution how LED modules are arranged on a light source plate of the light module also influence how the output light is rendered, because it is also related to a relative position of a single light source with respect to the lens module. When more than one LED modules are involved, it is usually favorable to prevent dark areas appearing in the output light. Therefore, the distribution of the LED modules of the light source module may be adjusted and determined accordingly based on a desired light effect and the optical characteristics of the lens module.

In some embodiments, the handle mentioned above may be added with control to another parameter. For example, by holding the handle and rotate the lens module may change the output light as mentioned before. A rotation structure, for example, may be added to the handle so that another parameter, like a desired color temperature, a color, a luminance level, may be set by rotating the rotation structure. The rotation structure may send an associated command to a driver with electronic, mechanical or physical structures. For example, the rotation structure changes an adjustable resistance value supplied to a driver integrated circuit chip that adjusts relative driving currents or duty ratios of PWM driving currents to two or more types of LED modules, thus changing a mixed color temperature or a mixed color.

There are various ways to implement this invention concept. For another example, a button may be disposed to the handle, or by bending the handle to different tilt angles, different settings may be selected for producing a final output light.

DETAILED DESCRIPTION

Figure 1:
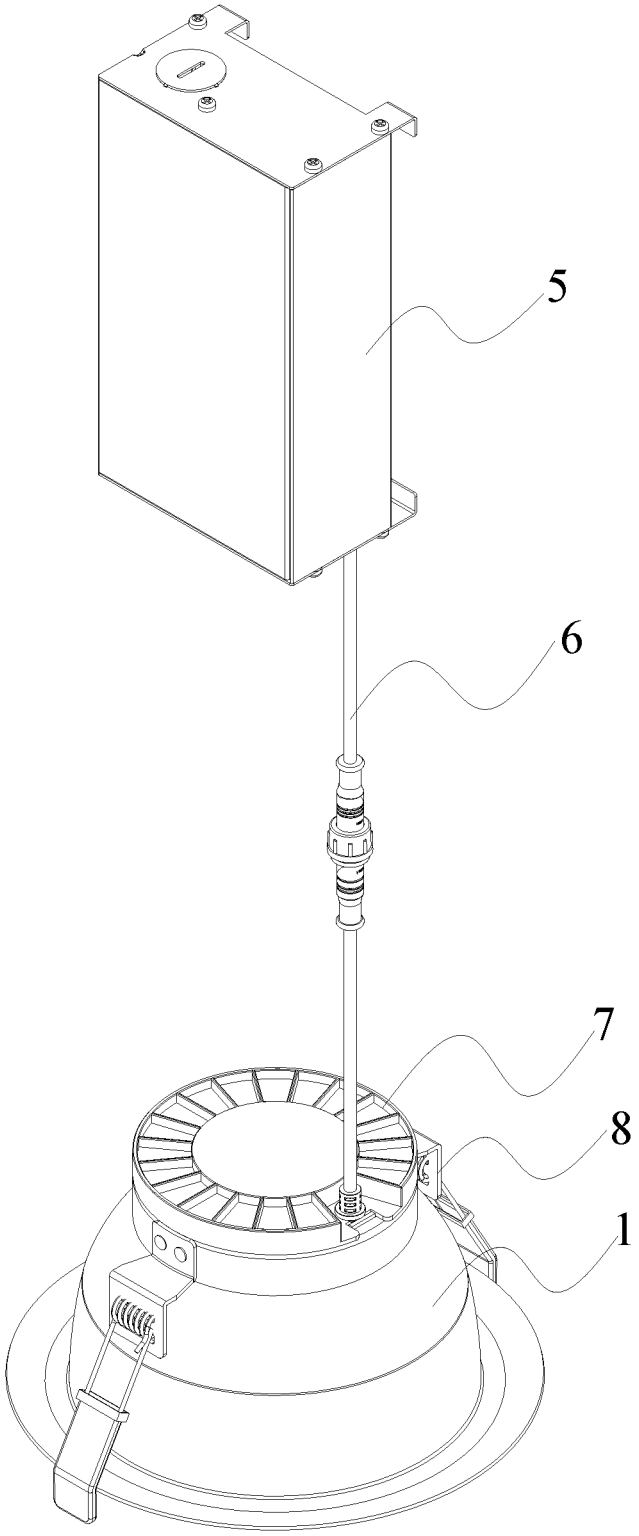
FIG. 1 is a downlight apparatus embodiment.

Please refer to FIG. 1. FIG. 1 shows an example embodiment of a downlight apparatus. The downlight apparatus includes a driver 5, a connection wire 6, a top cover 7, an elastic spring 8, a container housing 1. The elastic spring 8 is a pair structure to be expanded for defining a larger area so that holding the downlight apparatus in a cavity or an installation box of a ceiling. During installation, the elastic spring is pressed to decrease their expanding diameter to enter an opening of the cavity of the installation box. After the downlight apparatus enters the cavity, the elastic spring 8 is released, expanding back to its natural area to keep the downlight apparatus staying to a ceiling.

The driver 5 contains driver circuits for converting an external power source like 110V or 220V alternating currents to proper driving currents to a light source module disposed in the container housing 1.

Figure 2:
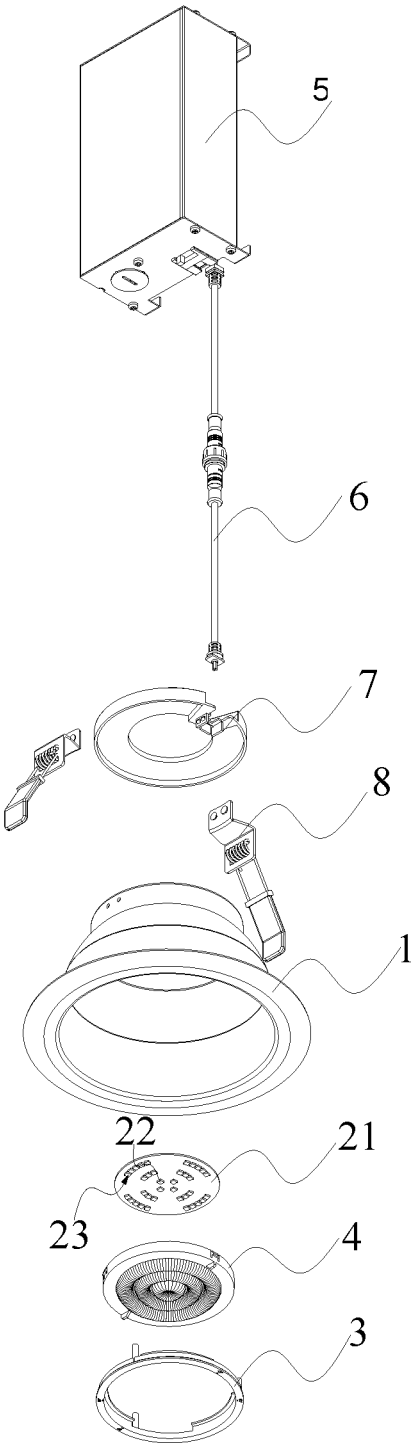
FIG. 2 is an exploded diagram of the embodiment of FIG. 1.

Please refer to FIG. 2. In the following description, reference numerals refer to the same components if they have the same values.

In FIG. 2, the driver 5 is connected to the wire 6 that passes through a terminal opening 7 connecting to a light source plate 21 that contains a first type of LED module 22 and a second type of LED module 23. The first type of LED module 22 has different optical characteristics as the second type of LED module 23, e.g. with different color temperatures. The light source plate 21, the first type of LED module 22 and the second type of Led module 23 together with other components form a light source module.

The light source plate 21 is attached to the container housing 1 in this embodiment. There is a lens module 4 disposed between a bracket 3 and a main body of the container housing 1. In some embodiments, the bracket 3 is a part of the container housing 1. The main body and the bracket 3 together form a movable space that contains the lens module 4 and allowing the lens module 4 to move, e.g. to rotate in the movable space.

In an embodiment, a downlight apparatus includes a container housing, a light source module and a lens module.

The container housing has a light opening and a container space. The light source module is disposed in the container housing for emitting a first light to the light opening.

The lens module is disposed in a light emitting path of the light source module toward the light opening. For example, the light source module includes multiple LED modules mounted on a light source plate. The light source plate is fixed to the container housing. When the LED modules are driven with proper driving currents, the LED modules emit light to the light opening. In some embodiments, each LED module emits most of light, e.g. more than 80%, within 120 degrees from center of the LED module. When multiple LED modules are disposed close to each other, these LED modules together emit a wider light.

In some embodiments, the lens module is attached to the container housing with fixing structure like screws, support columns, socket structures, locking structures. In some embodiments, there is some remaining space in the containing space except for space occupied by the light source module. In such remaining space, heat sink elements may be disposed for helping carry heat generated by the light source module.

The lens module is manually movable for adjusting a first relative position with respect to the light source for adjusting an output light. Users may touch a portion of the lens module directly for moving the lens module. Alternatively, users may control a control unit connected to the lens module for moving the lens module with respect to the light source module to a different first position.

For example, when there are different lens areas arranged on the lens module for providing different optical conversion, positions of one or more LED modules, e.g. directly on top of a lens area or with an angle with respect to the lens area, cause different conversion result, e.g. different light beam widths, different light patterns.

The output light is generated by passing the first light through the lens module, e.g. from refraction. By preparing different lens surface and related parameters, the output light may have different optical characteristics.

In some embodiments, the lens module contain lens for decreasing blue light component, to prevent damage of human eyes while being exposed to the blue light for too much time.

The light components of the light source module may receive driving currents from a separate driver module. The driver module converts an external power source, like 110V or 220V alternating current to direct currents of lower voltage level as driving currents to the light source module.

Pulse modulation or other driving mechanisms may be used by the driver module to provide driving currents to the LED module. In some embodiments, users may also control the driver module to adjust light strength of the output light. When adjusting the light strength of the output light, different types of LED modules of the light source module may be adjusted with different changing ratios, thus changing other optical characteristics while changing overall luminance level. For example, the decreasing of luminous level may simulate sunlight spectrum from noon to sunset, while color temperature also changes when luminance level is changed.

Such control may also be issued from an external device, e.g. via a wire or a wireless channel. The external device may be a mobile phone implementing a IoT (Internet of Things) protocol for sending an external command to the driver module. In some other embodiments, the external device may be a specific remote control or another downlight apparatus that issues commands to perform co-working among multiple downlight apparatuses.

When the external command is sent via a wireless channel, e.g. via Wi-Fi, Bluetooth, Zigbee, Z-wave, there is an antenna and a communication circuit disposed in or coupled to the driver module. In such case, the antenna may be disposed at the lens module, e.g. on surface of the lens module, to get best communication quality.

The driver module may be disposed in a driver container that is attached or mounted to the container housing. In some other embodiments, the driver module is connected to the light source module via a though hole of the container housing using a wire. In the intermediate contact between the light source module and the driver module, a plugging structure, e.g. a pin and associated socket may be used.

In some embodiments, driver components may be disposed and integrated with the light source module, e.g. placing driver circuits on a substrate that is also used for mounting LED modules.

The main housing may have a cup shape, with a closed top, a lateral wall and a light opening on opposite end to the closed top.

The light source module may be a light source plate disposed closer to the closed top than to the light opening.

There may be one or more support elastic arms, expandable for keeping the main housing staying in an installation cavity of a ceiling. The support elastic arms may be fixed at lateral wall of the container housing.

The concept mentioned here is not limited to downlight apparatuses. For example, spot light apparatuses may also be modified to integrate one or more features mentioned in this disclosure. For example, a spot light apparatus is used for generating a light beam to emphasize an object. Usually, the spot light apparatus has a lens for condensing its output light as a light beam. By arranging surface and optical parameters of its lens with one or more features mentioned below, one spot light apparatus may be conveniently to serve different needs, generating different output light types.

In addition to components specifically mentioned in this disclosure, other components like heat sink structures, reflective cups, heat dissipation air filling, may also be applied to embodiments mentioned here. Besides, the light source module may also include another lens module, e.g. some small lens directly mounted above LED modules, in addition to the lens module that is movable mentioned here.

In some embodiments, the light source modules may contain multiple types of LED modules, e.g. red, green, blue, white LED modules. In some embodiments, there are two types of white LED modules with different color temperatures. By mixing different types of LED modules, various light outputs may be provided by the same light source module.

In some embodiments, the lens module is rotated with respect to the container housing for adjusting the output light. For example, the lens module may have a lens with different lens areas. By rotating the lens, in such case, changes what lens area is below a LED module, thus generating different output light parameters.

In some embodiments, the lens module is moved to adjust a relative distance to the light source module for adjusting the output light. This is another way to change output light even the lens module has a lens with only one type of lens area. By adjusting relative distance, e.g. a type of a relative position, the output light is adjusted under optical refraction principles.

In some embodiments, there are multiple position structures for movably holding the rotated lens module to generate multiple corresponding output parameters of the output light. Specifically, there are several preferred positions corresponding to several preferred settings when designing the downlight apparatus. In such case, certain grooves and associated elastic blocks for providing a stable force to keep the lens module to keep in a preferred relative position are provided to guide and to keep the statuses for quick setting.

In some embodiments, the container housing has a bracket and a main body. The lens module is confined and placed between the bracket and the main body. Like a sandwich, in such embodiments, the lens module is kept movable while not being able to completely escape away from the main body and the bracket.

The fixture between the bracket and the main body may be detachable, e.g. with a buckle, a hooker, a plugging structure, or may be fixed, e.g. with glue, screws.

In some embodiments, the bracket has a peripheral part and a light passing cover. The peripheral part holds the light passing cover. For example, the peripheral part is a ring and the light passing cover is fixed in the ring.

The output light further passes through the light passing cover. The peripheral part may be fixed to the light module so that the light passing cover is integrated with the lens module as an integrated unit. Alternatively, these two parts may be separable.

In some embodiments, the light passing cover diffuses the output light, converting an input light to a soften light without intense light points. The surface of the light passing cover may be roughened to diffuse light, or be made of material that has mixed some particles to refract lights randomly.

In some embodiments, the light passing cover has multiple micro convex structures on one side or on both sides. The micro convex structure may have a diameter less than 5 mm. Such micro convex structures may be arranged closely forming a shining surface condensed by a lot of tiny spherical surfaces.

In some embodiments, a second lens position between the light passing cover and the lens is adjusted for adjusting an emitted light generated by passing the output light through the light passing cover. Specifically, in addition to adjust relative positions of the lens module and the container housing, the positions between the lens module and the light passing cover may also be adjusted so as to obtain more setting flexibility.

In some embodiments, the lens module may have a diffusion layer while the light passing cover has a condensed lens. Such setting is not conventional, but provides a different visual effect, better fitting some needs in some situations.

The emitted light is the output light of the lens module that is further converted by the light passing cover.

In some embodiments, the lens module has a handle confined within a movable area defined by the bracket. For example, the bracket has a peripheral wall that has a enclosing thin spacing for the handle to move inside. The handle is moved by a user and the handle is connected to the lens module. Thus, the lens module is moved. In this case, when the bracket is fixed to the container housing, the lens module is moved with respect to the container housing. The light module is fixed to the container housing, and consequently, the lens module is moved with respect to the light module when the handle is moved by the user.

Certain driving and linkage structure may be used for triggering movements as mentioned above. Therefore, in addition to have a direct and rigid linkage between the handle and lens module, certain intermediate structure like a pushing lever or more complicated structures may be used. In addition, the relative movement between the lens module and container housing may be achieved by an intermediate linkage structure. In some embodiments, the lens module may also be rotated like a round disk moving in a corresponding round track, just carried by a movement applied to the handle.

The thin spacing or a slit with its boundary may define a limited rotation range. In the movable range, several predetermined positions may correspond to several preferred settings. For users to easily identify the setting, some labels may be marked on the surface of the bracket so that users may see these labels.

In some embodiments, the light passing cover is integrated with the lens module, instead of being fixed to the container housing. In some embodiments, the light passing cover may be directly fixed to the lens module with a distance or directly attached to surface of a major lens of the lens module.

In some embodiments, the light passing lens is integrated with the lens module but still movable with respect to a major lens of the lens module that is used for converting the first light into the output light. The light passing cover, as mentioned above, converts the output light further to the emitted light escaped outside the downlight apparatus.

In some embodiments, there are multiple different lens areas disposed on the lens module for generating different conversion characteristics of the output light corresponding to the same first light. Specifically, when a light emitted from a LED module to a lens area with a relative angle, the light is refracted based on a curve surface and related optical characteristics of the lens area. A slight position change between the lens region and the LED module affects how an associated output light is rendered. When the lens module is moved more so that the LED module now emits the light to another lens region which has different optical characteristics as the previous lens region, a different output light is rendered again. In other words, different output lights, e.g. light beam width, light pattern, may be obtained by moving the lens module with respect to the container housing and the light module fixed to the container housing, even in the same downlight apparatus.

In some embodiments, different lens areas are arranged in an interleaved sector manner, so that several types of the output light appear in a corresponding interleaved manner when the lens module is moved continuously. The interleaved sector manner refers to that a lens area is expanded from one end close to a center with a same angle to another end away from the center.

In some embodiments, two types of lens areas are disposed, corresponding to movable spacing defined by the bracket mentioned above. More than two types of lens areas may be disposed, depending on design requirements.

In some embodiments, some lens area types correspond to condense light while some other lens area types correspond to diversify light. In some other embodiments, all lens area types in a lens module are used for condensing light but different lens area types have different focus length or different light beam width, e.g. some producing wider light beams than others.

In some embodiments, a first side of the lens module have multiple convex rings surrounding one after another extended from center to peripheral area. These convex rings form corresponding ring lens. Furthermore, each convex ring has micro convex belt lens distributed in a direction perpendicular to the convex ring.

Figure 4:
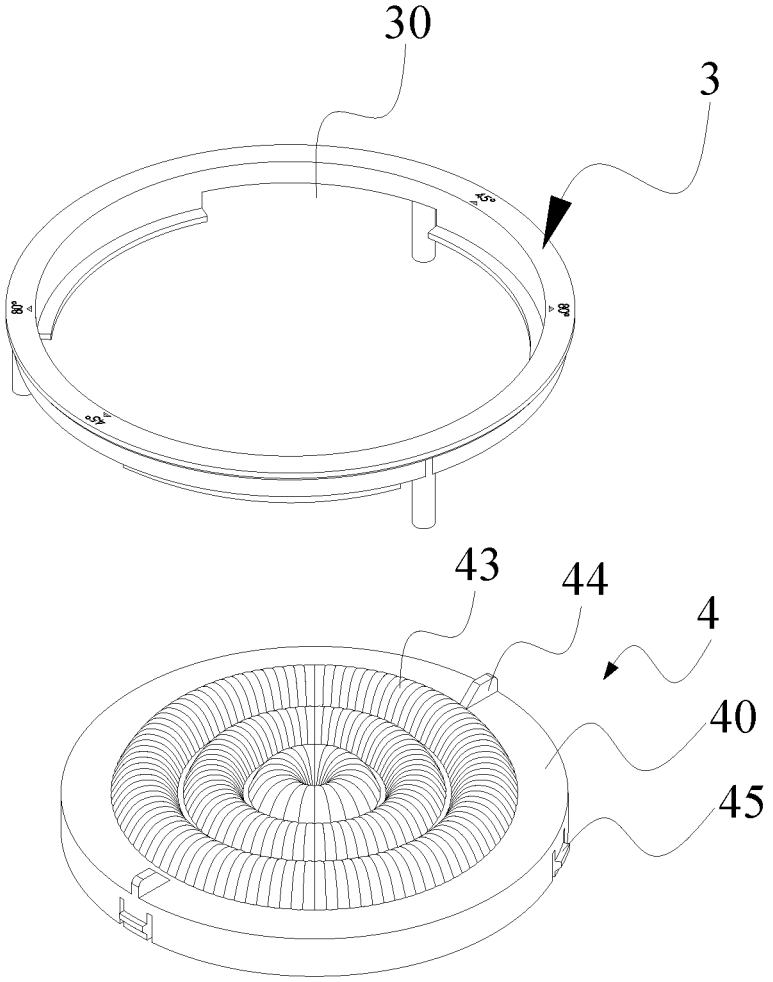
FIG. 4 illustrates a bracket and a second side of the major lens of the lens module of FIG. 3.

Please refer to FIG. 4, the ring lens 43 is circularly arranged with convex body. Along the perpendicular direction of the ring lens 43, there are multiple convex structures form a special type of ring lens 43. In FIG. 4, there are three ring lens 43. In other embodiments, the number of the ring lens 43 may be increased and decreased depending on design needs.

Such lens surface produces nice visual and luminance effect, different from conventional lighting effect.

In some embodiments, a second side of the lens module includes one or more than one concave areas. These concave areas form another types of lens working together with the lens ring on the other side to render desired output light pattern. As mentioned above, in some embodiments, there are several lens types arranged in an interleaved sector manner and so can be these concave areas.

The major lens of the lens module may be made of a one-piece plastic block by molding, forming customized convex-concave structures for generating desired lens effect.

In some embodiments, the second side of the lens module further comprises a plane area. In such design, on the second side of the lens module, there are some parts arranged with plane areas while other parts arranged with concave areas, which may be regarded as concave lens. Different surface curve shapes formed by both sides of the lens module produce different optical refraction parameters. In addition, different relative positions between the lens module and the light source module also influence how the output light is rendered.

Furthermore, by arranging the LED modules of the light source module in specific distribution corresponding to the lens structures further add design possibility to make the combination more flexible and more interesting.

Figure 3:
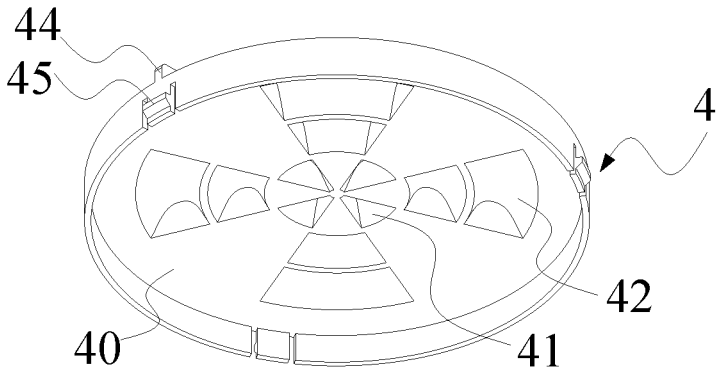
FIG. 3 illustrates a first side of a major lens of a lens module.
Figure 5:
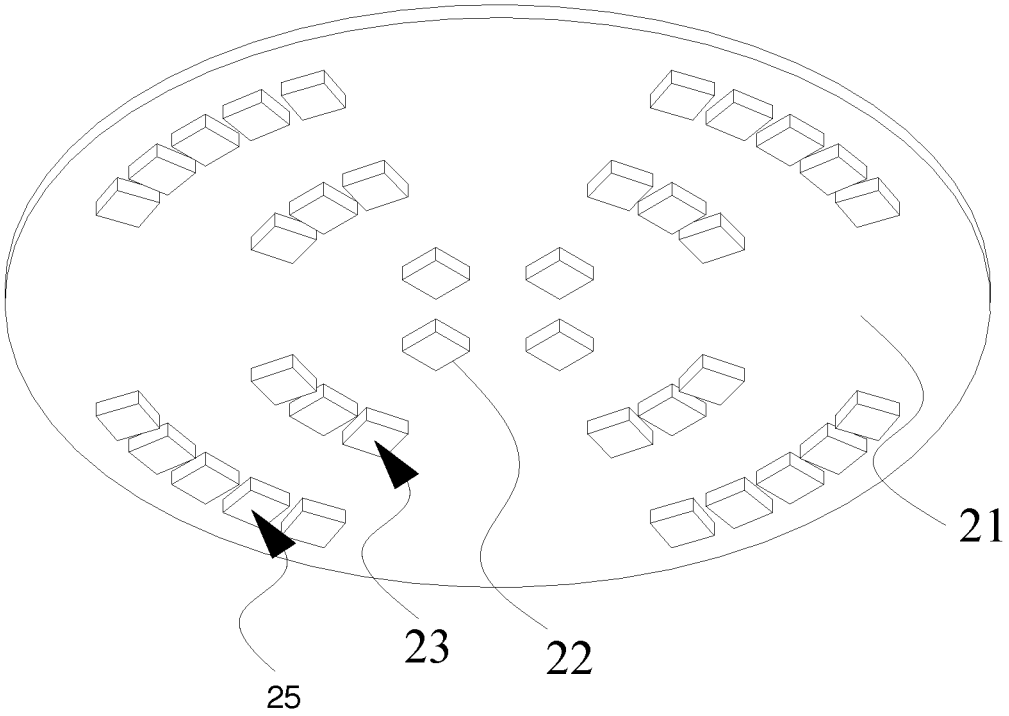
FIG. 5 illustrates multiple LED modules are disposed on a light source plate to form a light source module.

In FIG. 5, the light source module has a first type of LED module 22, a second type of LED module 23, and a third type of LED module 25. Please be noted that the example shows a favorable LED module arrangement corresponding to the lens module illustrated in FIG. 3 and FIG. 4. When the lens module is changed, the arrangement of the LED modules may be changed correspondingly to get best effect.

In some embodiments, a desired light pattern of a output light is set and equations under optical rules are solved to find out associated lens area design of the lens module. Such equations may be solved or calculated with conventional optical simulation tools. Persons of ordinary skill in the art are supposed to be able to implement the LED module and the lens module to find out corresponding parameters to achieve the design goals, including the variation effect, options of effect to select.

In some embodiments, there are multiple types of the LED modules disposed at LED positions corresponding multiple lens areas of the lens module. As mentioned above, the relative positions between the light source module and lens module influence how an output light is rendered. On the other hand, the distribution how LED modules are arranged on a light source plate of the light module also influence how the output light is rendered, because it is also related to a relative position of a single light source with respect to the lens module. When more than one LED modules are involved, it is usually favorable to prevent dark areas appearing in the output light. Therefore, the distribution of the LED modules of the light source module may be adjusted and determined accordingly based on a desired light effect and the optical characteristics of the lens module.

In some embodiments, the handle mentioned above may be added with control to another parameter. For example, by holding the handle and rotate the lens module may change the output light as mentioned before. A rotation structure, for example, may be added to the handle so that another parameter, like a desired color temperature, a color, a luminance level, may be set by rotating the rotation structure. The rotation structure may send an associated command to a driver with electronic, mechanical or physical structures. For example, the rotation structure changes an adjustable resistance value supplied to a driver integrated circuit chip that adjusts relative driving currents or duty ratios of PWM driving currents to two or more types of LED modules, thus changing a mixed color temperature or a mixed color.

There are various ways to implement this invention concept. For another example, a button may be disposed to the handle, or by bending the handle to different tilt angles, different settings may be selected for producing a final output light.

Figure 6:
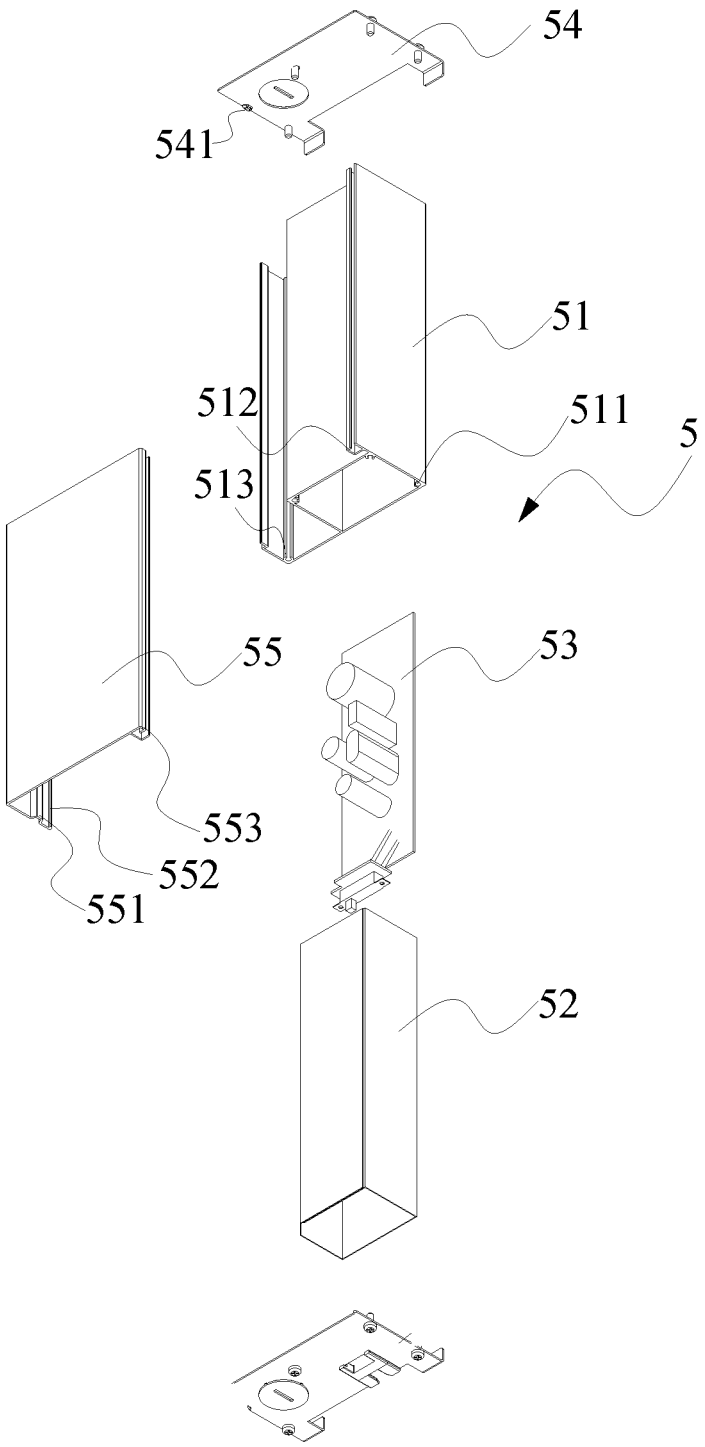
FIG. 6 is an exploded diagram of a driver that contains a driver box.
Figure 7:
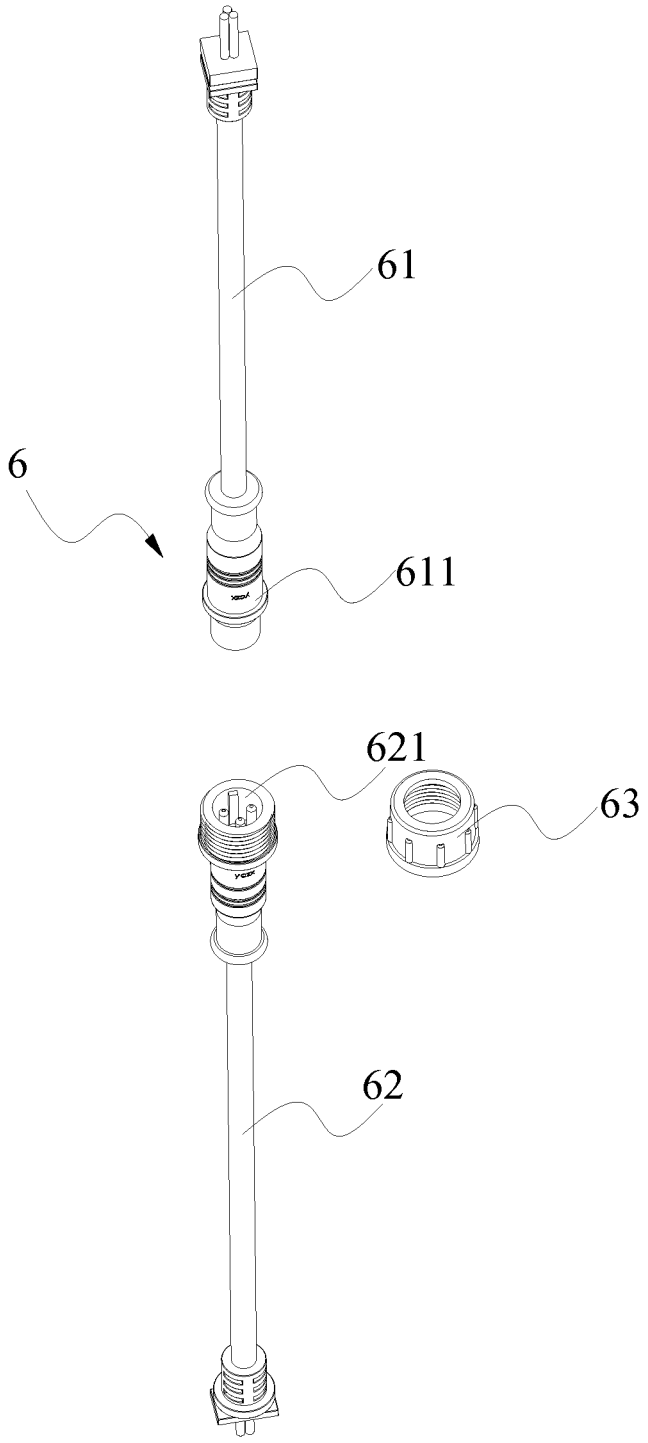
FIG. 7 illustrates a connection of two wires between the driver and the light source module.

Please refer to FIG. 6. In FIG. 6, the driver 5 includes a driver box. The driver box has a top cover 54. There is an prepared opening 541 for inserting wires.

There is a top cover 55 that has sliding structure 553, 551, 552 for sliding into corresponding tracks 512, 513 of a base housing 51. There is an opening 511 from which the driver circuit board 53 is inserted. There is a shield 52 for protecting the driver circuit board 53.

Please refer to FIG. 6. In FIG. 6, the wire is composed of a first wire 61 and a second wire 62. The first wire 61 has a first wire terminal 611 corresponding to a second wire terminal 621. A fastener 63 is used for fixing the connection between the first wire terminal 611 and the second wire terminal 621.

Figure 8:
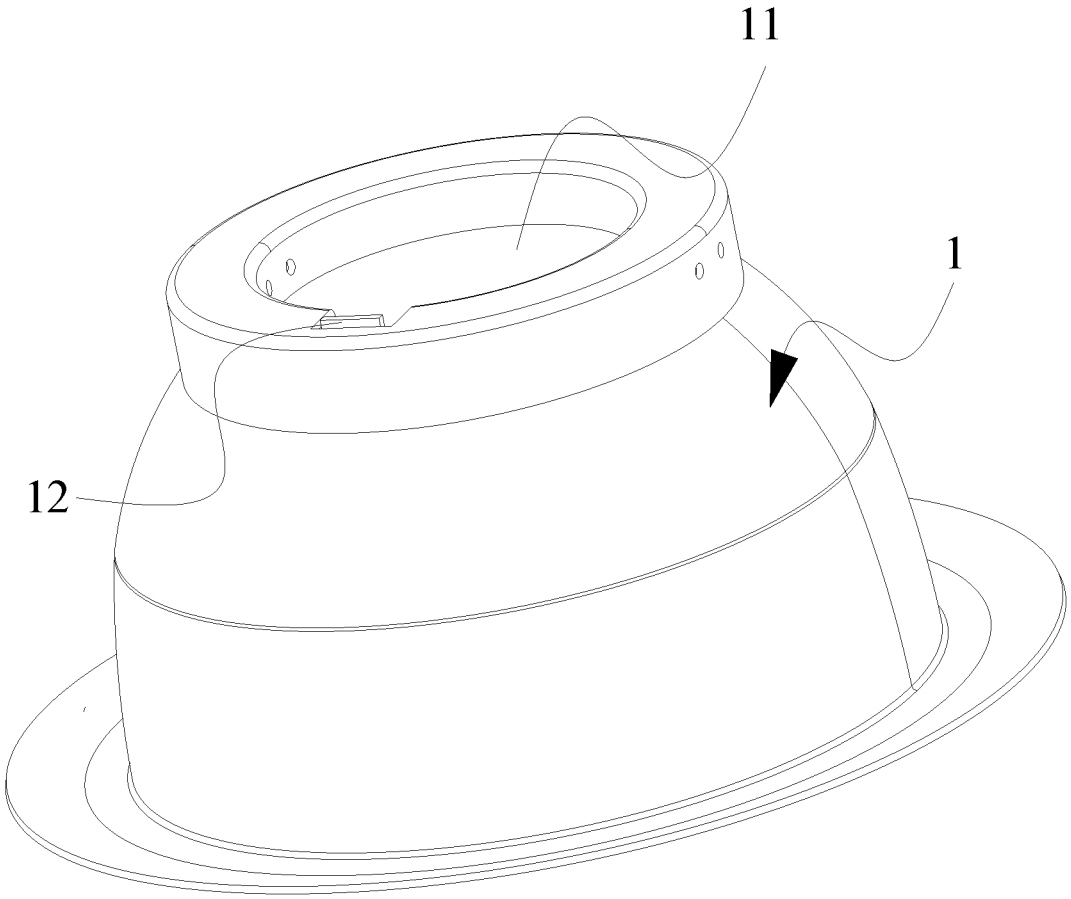
FIG. 8 shows an enlarged view of a container housing.

Please refer to FIG. 8. The container housing 1 has a top cover 11. There is a socket 12 reserved for inserting a wire from the driver.

Figure 9:
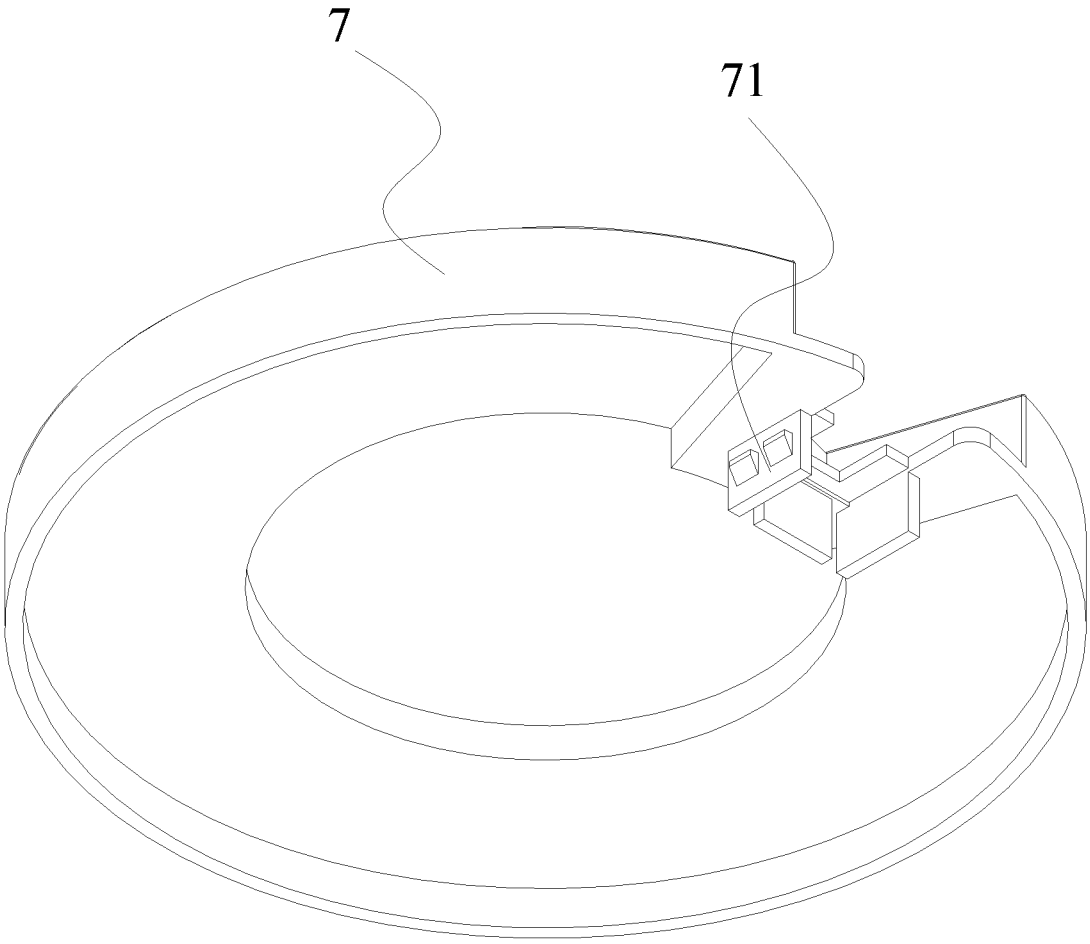
FIG. 9 shows a top cover disposed on top of the container housing.

Please refer to FIG. 9. The top cover 7 has a terminal structure 71, which is used to be connected to the container housing.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a container housing with a light opening and a container space;

a light source module disposed in the container housing for emitting a first light to the light opening;

a lens module disposed in a light emitting path of the light source module toward the light opening, the lens module being attached to the container housing and manually movable for adjusting a first relative position with respect to the light source for adjusting an output light, the output light being generated by passing the first light through the lens module;

a driver module; and a handle to be operated by a user for moving the lens module with respect to the container housing wherein the handle is also for setting a mixed parameter for the driver module to drive multiple types of LED modules of the light source module.

2. The downlight apparatus of claim 1, wherein the lens module is rotated with respect to the container housing for adjusting the output light.

3. The downlight apparatus of claim 1, wherein the lens module is moved to adjust a relative distance to the light source module for adjusting the output light.

4. The downlight apparatus of claim 1, wherein there are multiple position structures disposed on the lens module for movably holding the lens module to generate multiple corresponding output parameters of the output light.

5. The downlight apparatus of claim 1, wherein the container housing has a bracket and a main body, the lens module is confined and placed between the bracket and the main body.

6. The downlight apparatus of claim 5, wherein the bracket is detached from the main body for installing the lens module and then attached back to the main body.

7. The downlight apparatus of claim 5, wherein the lens module has a handle confined within a movable area defined by the bracket, the handle is movable by a user for moving the lens module with respect to the light source module.

8. The downlight apparatus of claim 1, wherein the lens module comprises a major lens and a light passing cover, the output light output from the major lens further passes through the light passing cover.

9. The downlight apparatus of claim 1, wherein there are multiple different lens areas disposed on the lens module for generating different conversing characteristics of the output light corresponding to the same first light.

10. The downlight apparatus of claim 9, wherein different lens areas are arranged in an interleaved sector manner.

11. The downlight apparatus of claim 1, wherein a first side of the lens module comprises multiple convex rings surrounding one after another.

12. The downlight apparatus of claim 1, wherein a second side of the lens module comprises a concave area.

13. The downlight apparatus of claim 12, wherein the second side of the lens module further comprises a plane area.

14. The downlight apparatus of claim 9, wherein the multiple types of the LED modules are disposed corresponding multiple lens areas of the lens module.

15. The downlight apparatus of claim 1, wherein changing the relative position between the light source module and the lens module causes a different driving parameter for driving the multiple types of LED modules of the light source module.

* * * * *